United States Patent [19]

Galgana et al.

[11] Patent Number: 4,715,763

[45] Date of Patent: Dec. 29, 1987

[54] DRY ASH REMOVAL SYSTEM

[75] Inventors: Russell J. Galgana, Clarksville; Patrick F. Mahoney, Rensselaer, both of N.Y.; Gordon L. Sutin, Dundas, Canada

[73] Assignee: Smith & Mahoney, P.C., Albany, N.Y.

[21] Appl. No.: 890,762

[22] Filed: Jul. 25, 1986

[51] Int. Cl.[4] ..... B65D 88/28; B65G 65/42; F23J 3/00

[52] U.S. Cl. ..... 414/216; 222/460; 414/196; 414/211; 414/291; 414/296

[58] Field of Search ..... 414/209–211, 414/216, 291, 296, 304, 196; 222/460, 462

[56] References Cited

U.S. PATENT DOCUMENTS

| | | | |
|---|---|---|---|
| 1,925,541 | 9/1933 | Noble | 222/460 |
| 3,302,598 | 2/1967 | Godel | 110/165 |
| 3,508,506 | 4/1970 | Bishop | 34/169 |
| 4,058,239 | 11/1977 | Van Mill | 222/462 |
| 4,061,221 | 12/1977 | Higashinaka et al. | 414/291 X |
| 4,321,877 | 3/1982 | Schmidt et al. | 110/186 |
| 4,463,686 | 8/1984 | Premel | 110/165 R |
| 4,503,783 | 3/1985 | Musschoot | 110/165 R |

FOREIGN PATENT DOCUMENTS

| | | | |
|---|---|---|---|
| 1129379 | 12/1984 | U.S.S.R. | 414/291 |

*Primary Examiner*—Kenneth J. Dorner
*Assistant Examiner*—Peter R. Brown
*Attorney, Agent, or Firm*—Hoffmann & Baron

[57] ABSTRACT

A hopper for use in a dry ash removal system is structured with a front elevational profile which converges from top to bottom while the side elevational profile of same diverges from top to bottom to allow substantially uniform hopper cross-sectional area from top to bottom and thereby reduce incidence of ash bridging within the hopper.

8 Claims, 3 Drawing Figures

10
12
14
16
18
20
22
24
26
30
32
34
36
40
42
48
50
52
54
56

DRY ASH REMOVAL SYSTEM

BACKGROUND OF THE INVENTION

Ash residue from burning of a solid fuel in a heat generator unit such as steam generator and/or an incinerator unit can be removed from the furnace of the heat generator unit in various and known manners. The ash residue composition depends on the type of solid fuel that has been fired or burned, coal, wood and shredded refuse being representative of fuel types. The ash composition will generally include a powder like ash of relatively small particle size but also may include larger particles such as "clinkers." Depending on furnace size, firing rate and like facators the ash removal from the furnace can be effected on a continuous or intermittent basis. The removal of the ash desirably is made in such way as to prevent any disrupiton of the draft air being supplied to the furnace combustion operation, as can occur since at least at the draw off or ash removal location communication with ambient air outside the furnace is possible. Thus the ash may be withdrawn by way of a confined bulk ash collection that itself serves as an ash seal to prevent incursion of any significant unbalancing air flow to the furnace as ash is being removed from the bottom of the collected ash stock as, e.g., by a conveyor. Ash also may be drawn off from the furnace through a water mass so that the water mass serves as an air incursion blocking means. When the ash removal operation includes collection of a stock of ash intermediate the furnace discharge location and the point of removal of the ash to a valuable waste products recovery operation such as in a hopper or a transfer chute, a problem of bridging or jamming of the ash in the hopper can arise particularly when the hopper follows or has a course alteration at a location between the entry and discharge ends of the hopper or where the hopper undergoes a sharp change, i.e., a reduction in cross-sectional area at a location between entry and discharge to an from the hopper. This bridging action diminishes the outflow rate of ash from the hopper, e.g., onto a carry-off conveyor with the result that ash build-up in the hopper can increase to the point of disrupting the efficiency of the combustion operation in the furnace and this notwithstanding that signal means detecting the build-up may become operable to speed up the conveyor operation. Conveyor speed up is to no avail since the bridging condition continues to preclude required ash outflow rate from the hopper.

SUMMARY OF THE INVENTION

The present invention relates to an improved ash removal system wherein dry ash is removed from a furnace and delivered to a point of use for further utilization of any valuable waste products as may be present in the ash. In particular the invention is directed to the construction of a hopper structure for communicating ash outlet from the furnace to a conveyor by which the ash is carried off to a further utilization point of use. The hopper is characterized by a configuration thereof which in front elevational profile converges from top to bottom and along generally uniformly inwardly tapering marginal extremities. As viewed in side elevational profile, the hopper has a configuration which diverges from top to bottom and along generally uniformly outwardly tapering marginal extremities. This profile arrangement provides that the cross-sectional area of the hopper from top entry thereto to bottom outlet therefrom and at any location therebetween, is of substantially uniform or constant measure. The hopper presents no sharp course alteration therein or cross-sectional area reduction which could inhibit smooth ash flow within the hopper structure. Thus undesirable bridging of the ash within the hopper is prevented. "Bridging" as used herein is understood as having its well known meaning of the tendency or action of certain forms of particulate or grannular material to form a bridge of such material in crossing over in blocking position proximate an outlet at the bottom of a confined mass of such material.

The hopper in a particularly advantageous embodiment thereof has opposed front and rear walls and a pair of opposed side walls, one pair of said walls having side margins which converge from top to bottom and the other pair having side margins which diverge from top to bottom, the side margins of such walls preferably following straight line courses and the walls being planar.

Discharge from the hopper can be onto a conveyor of known type such as a vibratory pan conveyor which can be designed to carry the ash frontally relatively of the furnace, then discharge the ash into a dust plenum for separation of light ash particles from the mass and recycle thereof to the furnace for ultimate collection of the lighter particles in the heat generator unit particulate emission control system as part of the fly ash.

The advantages and further features of the invention will be made more apparent from the following detailed description to be given hereinafter and will be described in terms of such features of construction, combination of elements and arrangement of parts as will be exemplified in the construction set forth and the scope of the invention will be indicated in the claims.

BRIEF DESCRIPTION OF THE DRAWINGS

A fuller understanding of the nature and objects of the invention will be had from the following detailed description taken in conjunction with the accompanying drawings in which.

Throughout the following description, like reference numerals are used to denote like parts in the drawings.

DESCRIPTION OF THE PREFERRED EMBODIMENTS

Figures 1, 2, 3:
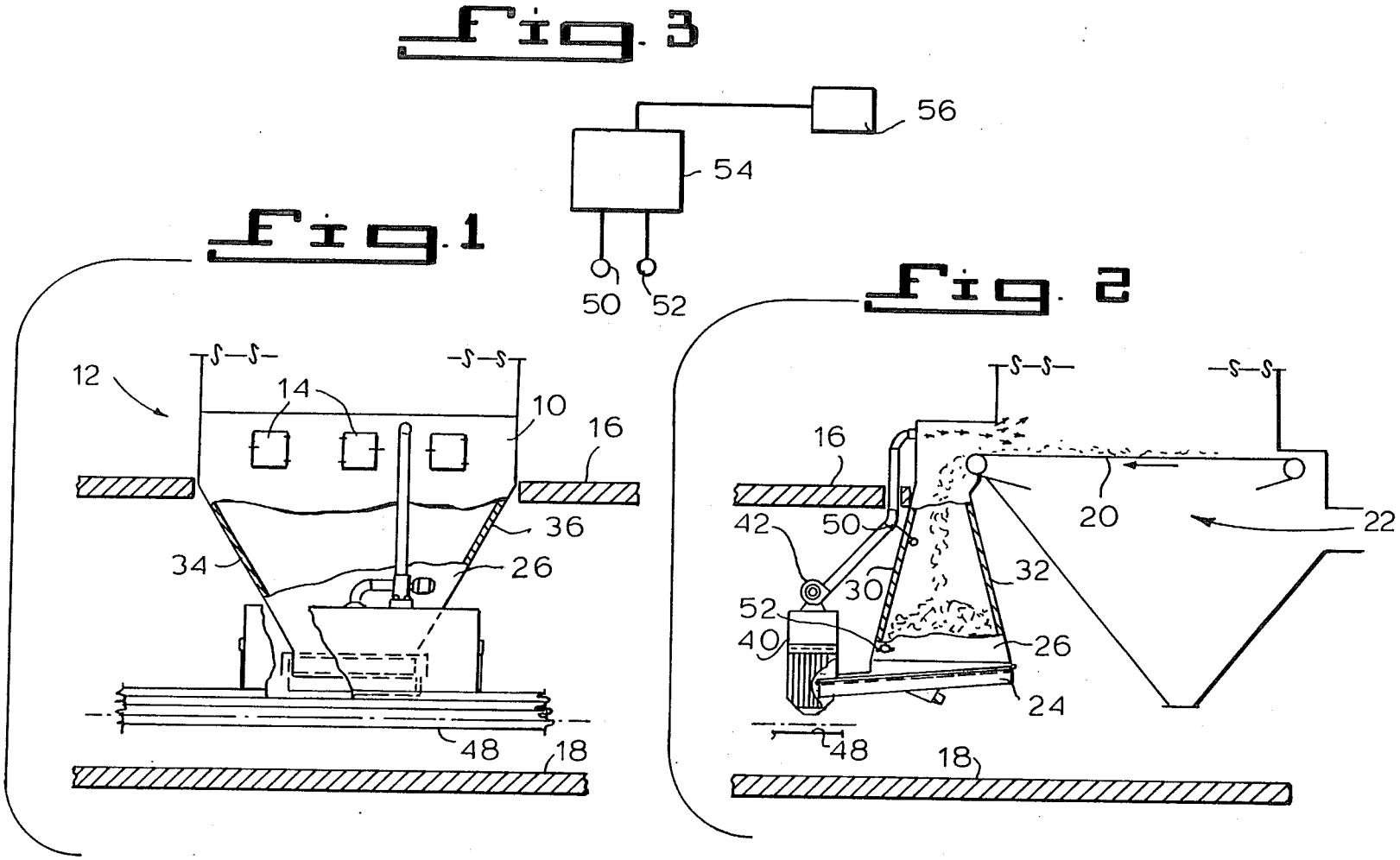
FIG. 1 is a front elevational view with portions broken away of the furnace section of a solid fuel fired heat generator unit and depicting an ash removal hopper constructed in accordance with the principles of the present invention for connecting the furnace section with an ash carry-off conveyor disposed some distances below the furnace, there further being shown a dust plenum unit to which the said carry-off conveyor discharges the ash.
FIG. 2 is a side elevational view of FIG. 1.
FIG. 3 is a schematic depiction of a means for controlling the operation of the carry-off conveyor by means of high and low ash level sensors located within the hopper.

Referring to FIGS. 1 and 2 there is shown the lower portion, i.e., the furnace section 10 of a solid fuel fired heat generator unit 12 which could be a boiler or an incinerator. The furnace front is as seen in FIG. 1 of elongated span and it is provided with a number of ash pit doors as at 14 with the furnace being disposed at a floor level 16, below which is shown a further floor level 18, the space between the two floor levels being provided for the ash removal and furnace combustion air supply operation structures and components. As seen in FIG. 2, a conveyor 20 operates within the furnace 10 and travels toward the front of the furnace to carry solid fuel such as coal, wood or shredded refuse through the combustion zone with draft air being supplied as shown by arrow 22. Alternatively, the fuel could be combusted on a grate (not shown) disposed above the conveyor 20 and such conveyor being employed to collect and forwardly transport combusted fuel residue such as ash and slag or clinkers falling through the grate for discharge removal of same from the furnace.

Disposed below the furnace front and extending downwardly in communication therewith to a second or carry-off conveyor 24 is a hopper or conduit structure 26. The hopper 26 in the front elevational profile thereof seen in FIG. 1, has its maximum or widest lateral expanse at the top thereof and which expanse is equal to the furnace front length. That profile which is defined by front wall 30 and rear wall 32 opposed thereto, is of convergent character with the narrowest lateral expanse being at the hopper bottom, i.e., at the outlet therefrom and of such dimension as to be substantially equal to the width of the carry-off conveyor 24. The side elevational view profile of the hopper and as defined by opposed side walls 34,36 is on the other hand of divergent character with the minimum transverse expanse being at the hopper top entry location and the maximum transverse expanse being at the bottom outlet location, that maximum transverse expanse also proximating the width of conveyor 24. In the depicted hopper embodiment, the hopper walls have substantially straight side edges or margins which in the case of the front and rear walls follow the tapering uniformly convergingly from top to bottom courses shown while the side edges or margins of the side walls follow tapering uniformly diverging courses from top to bottom. The straight and angulated wall marginal courses are such that the cross-sectional area at the top hopper entry, bottom hopper outlet and hopper locations intervening therebetween is of substantially uniform or constant measure. The hopper walls are planar and this coupled with the constant cross-sectional area provides a hopper internal ash flow conduit which is not susceptible to promotion of bridging in the ash flow mass and especially at the hopper outlet region. There is no undesirable hopper course alteration or acute cross-sectional area constriction promotive of bridging as can be found in prior hopper or conduit constructions.

Outlet from the hopper 27 is as indicated to carry-off conveyor 24. Conveyor 24 can be any suitable type of device for that purpose with the particular unit 24 being a vibratory type of known construction such as a vibrating pan unit. Conveyor 24 can be downwardly inclined frontally away from the hopper 26 to facilitate ash travel therealong with discharge from the conveyor 24 being into dust plenum unit 40, the plenum unit 4o being under the influences of centrifugal fan unit 42 which inducts light ash particles floating in the plenum and transports them by air stream entrapment through pipe 44 to the furnace front and ultimate uptake in the combustion products stream from whence such light particles are collected in the emissions control system as fly ash. The heavier ash material is deposited from the plenum unit 40 onto a travelling belt or transporter 48 which takes the ash material to a further and useful recovery operation.

Depending on the firing rate in the heat generator, more or less ash will be produced. In a steady state situation, the ash present in the hopper 26 may, e.g., be at the layer level depicted in FIG. 2. Vibrating conveyor 24 can be operative such as is necessary to maintain this level. On the other hand if firing conditions change so as to either cause build-up or depletion of the ash level in the hopper, the high level sensor 40 or the low level sensor 52 mounted in the hopper in a side wall thereof will signal through a control unit 54 (FIG. 3) such condition and cause further signal control to the vibrating pan conveyor unit drive member 56 to either increase or slow down the speed at which the conveyor 24 is operating (or if necessary shut it down) and thereby insure that the ash level is maintained at requisite height. With an ash level or bed in the hopper, the same functions to mitigate against any gross incursion of outside air into the furnace as would disrupt the furnace draft. The air admitted through the ash seal of course serves to cool the ash and at the same time heat the air so that this air being incorporated in the combustion process contributes to increased combustion efficiency.

It will be understood that the hopper 26 is readily fabricated from steel plate with the side walls being connected, e.g., with welded joints or by flanged and bolted joints. Suitable clean out access doors (not shown) can be provided and the hopper can with ease be field erected and installed at an existing plant location. Further it will be noted that the walls are disposed at such angles as are equal to or greater than the angle of repose of ash material contained therein.

While there is above disclosed only one embodiment of the hopper of the present invention, it will be understood that various modifications can be made by those skilled in the art without departing from the scope of the disclosed invention.

What is claimed is:

1. An apparatus for removal of ash from the furnace of a solid fuel fired heat generator unit having a relatively elongated furnace front including means for collecting ash from beneath the furnace and advancing it to the furnace front, a conveyor located remote from the furnace front a distance therebelow, and a hopper connecting the furnace front with the conveyor to communicate ash from the furnace front to the conveyor, the conveyor being operable to convey ash forwardly relatively of the hopper, the hopper being characterized by a front elevational profile thereof of converging course from a widest lateral expanse thereof at entry thereto at the furnace front to a narrowest lateral expanse at outlet therefrom at said conveyor, and a side elevational profile of diverging course from a narrowest transverse expanse at the entry thereto to a maximum transverse expanse at the outlet thereof, the respective front and side elevational profiles following courses such that the cross-sectional area of said hopper from top to bottom is of substantially uniform measure.

2. The apparatus of claim 1 in which the front elevational profile is defined by opposed front and rear hopper walls, and the side elevational profile is defined by a pair of opposed side walls.

3. The apparatus of claim 2 in which the front and rear hopper walls have substantially straight side edges following courses tapering uniformly convergingly from top to bottom thereof, and the pair of opposed side walls have substantially straight side edges following courses tapering uniformly divergently from top to bottom thereof.

4. The apparatus of claim 1 in which said conveyor is disposed such as to convey ash outletting from said hopper forwardly relatively of said hopper outlet, the width of the transverse course of said conveyor being substantially equal to the hopper outlet lateral expanse.

5. The apparatus of claim 4 further including a dust separation plenum, the conveyor being communicated at a forward end thereof with said plenum, the plenum including a pneumatic separator unit for removing light ash particles from the ash and recycling same to the furnace.

6. The apparatus of claim 1 further including high and low level sensor means for detecting the presence of ash within said hopper between respective high and low vertical collected levels therein, said sensors being connected with said conveyor to control operation thereof.

7. In apparatus for receiving ash residue from a solid fuel combustion operation which includes a first conveyor for collecting and transporting the ash away from the combustion site, and a second conveyor disposed a distance below the combustion site and to which the ash can be delivered for further processing, a hopper structure extending between said first and second conveyors to establish communicative connection therebetween and said structure being defined by a a pair of opposed front and rear walls and a pair of opposed side walls, the walls of one such pair having side margins which converge from top to bottom and the walls of the other pair have side margins which diverge from top to bottom, all such side margins following straight line and angulated courses such that the cross-sectional area at the top hopper entry, bottom hopper outlet and hopper locations intervening therebetween is of substantially uniform measure.

8. The apparatus of claim 7 in which all of the hopper defining walls are of planar configuration.

* * * * *